US009863254B2

(12) United States Patent
Ceglio et al.

(10) Patent No.: US 9,863,254 B2
(45) Date of Patent: Jan. 9, 2018

(54) TURBINE AIRFOIL WITH LOCAL WALL THICKNESS CONTROL

(71) Applicant: GENERAL ELECTRIC COMPANY, Schenectady, NY (US)

(72) Inventors: Christopher Michael Ceglio, Salem, MA (US); Randall Charles Bauer, Loveland, OH (US); Stephen Mark Molter, Cincinnati, OH (US); Mark Edward Stegemiller, Franklin, OH (US)

(73) Assignee: General Electric Company, Schenectady, NY (US)

( * ) Notice: Subject to any disclaimer, the term of this patent is extended or adjusted under 35 U.S.C. 154(b) by 228 days.

(21) Appl. No.: 14/396,062

(22) PCT Filed: Apr. 23, 2013

(86) PCT No.: PCT/US2013/037753

§ 371 (c)(1),
(2) Date: Oct. 22, 2014

(87) PCT Pub. No.: WO2013/163150

PCT Pub. Date: Oct. 31, 2013

(65) Prior Publication Data

US 2015/0152734 A1 Jun. 4, 2015

Related U.S. Application Data

(60) Provisional application No. 61/636,908, filed on Apr. 23, 2012.

(51) Int. Cl.
*F01D 5/18* (2006.01)

(52) U.S. Cl.
CPC ..... *F01D 5/186* (2013.01); *F01D 5/187* (2013.01); *F05D 2250/292* (2013.01); *F05D 2260/202* (2013.01)

(58) Field of Classification Search
CPC .... F01D 5/186; F01D 5/187; F05D 2250/292; F05D 2260/202
See application file for complete search history.

(56) References Cited

U.S. PATENT DOCUMENTS 2,928,749 A 3/1960 Watts
3,090,691 A 5/1963 Weyer
(Continued)

FOREIGN PATENT DOCUMENTS

CN 1840859 A 10/2006
EP 0964981 A1 12/1999
(Continued)

OTHER PUBLICATIONS

Unofficial English Translation of Chinese Office Action issued in connection with corresponding CN Application No. 201380021404.2 dated May 5, 2015.
(Continued)

*Primary Examiner* — Igor Kershteyn
(74) *Attorney, Agent, or Firm* — General Electric Company; William Scott Andes

(57) ABSTRACT

A turbine airfoil for a gas turbine engine including an outer peripheral wall having an external surface, the outer peripheral wall enclosing an interior space and including a concave pressure sidewall and a convex suction sidewall joined together at a leading edge and at a trailing edge; wherein the outer peripheral wall has a varying wall thickness which incorporates a locally-thickened wall portion; and a film cooling hole having a shaped diffuser exit passing through the outer peripheral wall within the locally-thickened wall portion.

14 Claims, 6 Drawing Sheets

(56) References Cited

U.S. PATENT DOCUMENTS

| | | | | |
|---|---|---|---|---|
| 3,197,432 | A | 7/1965 | Lamoreaux | |
| 3,197,433 | A | 7/1965 | Lamoreaux | |
| 3,220,972 | A | 11/1965 | Lamoreaux | |
| 3,313,773 | A | 4/1967 | Lamoreaux | |
| 3,423,358 | A | 1/1969 | Oliver | |
| 3,438,936 | A | 4/1969 | Harry | |
| 3,516,946 | A | 6/1970 | Frank | |
| 3,692,086 | A | 9/1972 | Michelon | |
| 3,715,334 | A | 2/1973 | Karstedt | |
| 3,775,452 | A | 11/1973 | Karstedt | |
| 3,870,529 | A | 3/1975 | Okumoto et al. | |
| 3,957,715 | A | 5/1976 | Lirones et al. | |
| 4,086,311 | A | 4/1978 | Huseby et al. | |
| 4,097,292 | A | 6/1978 | Huseby et al. | |
| 4,108,672 | A | 8/1978 | Klug et al. | |
| 4,108,676 | A | 8/1978 | Huseby et al. | |
| 4,164,424 | A | 8/1979 | Klug et al. | |
| 4,184,885 | A | 1/1980 | Klug et al. | |
| 4,190,450 | A | 2/1980 | Burd et al. | |
| 4,191,582 | A | 3/1980 | Magee | |
| 4,221,903 | A | 9/1980 | Elfert et al. | |
| 4,222,983 | A | 9/1980 | August et al. | |
| 4,247,333 | A | 1/1981 | Ledder et al. | |
| 4,256,870 | A | 3/1981 | Eckberg | |
| 4,269,753 | A | 5/1981 | Mine et al. | |
| 4,288,345 | A | 9/1981 | Ashby et al. | |
| 4,323,756 | A | 4/1982 | Brown et al. | |
| 4,421,903 | A | 12/1983 | Ashby | |
| 4,724,299 | A | 2/1988 | Hammeke | |
| 4,730,093 | A | 3/1988 | Mehta et al. | |
| 4,888,376 | A | 12/1989 | Atwell et al. | |
| 4,894,194 | A | 1/1990 | Janney | |
| 4,901,450 | A | 2/1990 | Chemello et al. | |
| 4,906,424 | A | 3/1990 | Hughes et al. | |
| 4,998,581 | A | 3/1991 | Lane et al. | |
| 5,014,763 | A | 5/1991 | Frank | |
| 5,028,362 | A | 7/1991 | Janney et al. | |
| 5,038,014 | A | 8/1991 | Pratt et al. | |
| 5,043,548 | A | 8/1991 | Whitney et al. | |
| 5,126,082 | A | 6/1992 | Frank | |
| 5,162,480 | A | 11/1992 | Schilling et al. | |
| 5,337,568 | A | 8/1994 | Lee et al. | |
| 5,397,215 | A | 3/1995 | Spear et al. | |
| 5,419,039 | A * | 5/1995 | Auxier | B23P 15/04 29/889.7 |
| 5,433,261 | A | 7/1995 | Hinton et al. | |
| 5,635,250 | A | 6/1997 | Blum et al. | |
| 5,688,104 | A | 11/1997 | Beabout | |
| 5,824,250 | A | 10/1998 | Whalen et al. | |
| 5,927,379 | A | 7/1999 | Yasrebi et al. | |
| 5,931,638 | A | 8/1999 | Krause et al. | |
| 5,978,221 | A | 11/1999 | Sawa et al. | |
| 6,000,457 | A | 12/1999 | Vandermeer | |
| 6,017,186 | A | 1/2000 | Hoeger et al. | |
| 6,037,397 | A | 3/2000 | Satoh et al. | |
| 6,066,279 | A | 5/2000 | Walls et al. | |
| 6,087,024 | A | 7/2000 | Whinnery et al. | |
| 6,152,211 | A | 11/2000 | Klug et al. | |
| 6,228,299 | B1 | 5/2001 | Janney et al. | |
| 6,254,334 | B1 | 7/2001 | LaFleur | |
| 6,269,540 | B1 | 8/2001 | Islam et al. | |
| 6,273,682 | B1 * | 8/2001 | Lee | F01D 5/186 415/115 |
| 6,283,713 | B1 | 9/2001 | Harvey et al. | |
| 6,302,185 | B1 | 10/2001 | Lee et al. | |
| 6,338,609 | B1 | 1/2002 | Decker et al. | |
| 6,345,633 | B1 | 2/2002 | Tartakovsky et al. | |
| 6,345,663 | B1 | 2/2002 | Klug et al. | |
| 6,350,404 | B1 | 2/2002 | Li et al. | |
| 6,365,082 | B1 | 4/2002 | Walls et al. | |
| 6,368,060 | B1 | 4/2002 | Fehrenbach et al. | |
| 6,368,525 | B1 | 4/2002 | Klug et al. | |
| 6,375,880 | B1 | 4/2002 | Cooper et al. | |
| 6,379,528 | B1 | 4/2002 | Lee et al. | |
| 6,402,464 | B1 | 6/2002 | Chiu et al. | |
| 6,419,446 | B1 | 7/2002 | Kvasnak et al. | |
| 6,429,402 | B1 | 8/2002 | Dixon et al. | |
| 6,467,534 | B1 | 10/2002 | Klug et al. | |
| 6,481,490 | B1 | 11/2002 | Vihtelic et al. | |
| 6,485,553 | B1 | 11/2002 | Guinn | |
| 6,502,622 | B2 | 1/2003 | Lee et al. | |
| 6,504,127 | B1 | 1/2003 | McGregor et al. | |
| 6,511,294 | B1 | 1/2003 | Mielke et al. | |
| 6,546,730 | B2 | 4/2003 | Johnson et al. | |
| 6,561,761 | B1 | 5/2003 | Decker et al. | |
| 6,599,953 | B1 | 7/2003 | Ratke et al. | |
| 6,626,230 | B1 | 9/2003 | Woodrum et al. | |
| 6,648,645 | B1 | 11/2003 | MacDougald et al. | |
| 6,669,445 | B2 | 12/2003 | Staubach et al. | |
| 6,805,535 | B2 | 10/2004 | Tiemann | |
| 6,860,714 | B1 | 3/2005 | McNulty et al. | |
| 6,974,308 | B2 | 12/2005 | Halfmann et al. | |
| 6,981,840 | B2 * | 1/2006 | Lee | F01D 5/187 415/115 |
| 7,121,802 | B2 | 10/2006 | Athans et al. | |
| 7,134,842 | B2 | 11/2006 | Tam et al. | |
| 7,487,819 | B2 | 2/2009 | Wang et al. | |
| 7,503,749 | B2 | 3/2009 | Lee et al. | |
| 7,594,529 | B2 | 9/2009 | Jones | |
| 7,622,539 | B2 | 11/2009 | Fukui et al. | |
| 2001/0024000 | A1 | 9/2001 | Lee et al. | |
| 2002/0047229 | A1 | 4/2002 | Yanagisawa et al. | |
| 2002/0119045 | A1 * | 8/2002 | Starkweather | F01D 5/187 416/97 R |
| 2003/0015308 | A1 | 1/2003 | Fosaaen et al. | |
| 2003/0078334 | A1 | 4/2003 | Doles et al. | |
| 2005/0006047 | A1 | 1/2005 | Wang et al. | |
| 2005/0023710 | A1 | 2/2005 | Brodkin et al. | |
| 2005/0070651 | A1 | 3/2005 | McNulty et al. | |
| 2005/0156361 | A1 | 7/2005 | Holowczak et al. | |
| 2005/0199366 | A1 | 9/2005 | Vandermeer et al. | |
| 2005/0205232 | A1 | 9/2005 | Wang et al. | |
| 2006/0065383 | A1 | 3/2006 | Ortiz et al. | |
| 2006/0153681 | A1 | 7/2006 | Lee et al. | |
| 2006/0233641 | A1 | 10/2006 | Lee et al. | |
| 2006/0275112 | A1 | 12/2006 | Lee et al. | |
| 2007/0003416 | A1 | 1/2007 | Bewlay et al. | |
| 2007/0089849 | A1 | 4/2007 | McNulty et al. | |
| 2008/0027163 | A1 | 1/2008 | McNulty et al. | |
| 2008/0135202 | A1 | 6/2008 | Lee et al. | |
| 2008/0135718 | A1 | 6/2008 | Lee et al. | |
| 2008/0135721 | A1 | 6/2008 | Wang et al. | |
| 2008/0314445 | A1 | 12/2008 | McNulty et al. | |
| 2008/0314446 | A1 | 12/2008 | McNulty et al. | |

FOREIGN PATENT DOCUMENTS

| | | | |
|---|---|---|---|
| EP | 1015736 | A1 | 7/2000 |
| EP | 1016639 | A2 | 7/2000 |
| EP | 1079071 | A2 | 2/2001 |
| EP | 1495820 | A1 | 1/2005 |
| EP | 1526250 | A2 | 4/2005 |
| EP | 1552913 | A1 | 7/2005 |
| EP | 1614488 | B1 | 3/2014 |
| GB | 1034368 | A | 6/1966 |
| GB | 1409794 | A | 10/1975 |
| GB | 1409795 | A | 10/1975 |
| GB | 2040292 | A | 8/1980 |
| GB | 2040295 | A | 8/1980 |
| GB | 2174458 | A | 11/1986 |
| JP | 4895317 | A | 12/1973 |
| JP | 52107230 | A | 9/1977 |
| JP | 5431995 | A | 3/1979 |
| JP | 5445314 | A | 4/1979 |
| JP | 5964135 | A | 4/1984 |
| JP | 61152702 | U | 9/1986 |
| JP | 62121734 | A | 6/1987 |
| JP | 63242439 | A | 10/1988 |
| JP | 02188460 | A | 7/1990 |
| JP | 02303651 | A | 12/1990 |
| JP | 0488140 | A | 3/1992 |
| JP | 05262558 | A | 10/1993 |
| JP | 061605 | A | 1/1994 |
| JP | 06321624 | A | 11/1994 |

(56) References Cited

FOREIGN PATENT DOCUMENTS

| | | | |
|---|---|---|---|
| JP | 08143613 | A | 6/1996 |
| JP | 08509665 | A | 10/1996 |
| JP | 09285839 | A | 11/1997 |
| JP | 2000071057 | A | 3/2000 |
| JP | 2000301289 | A | 10/2000 |
| JP | 2001511864 | A | 8/2001 |
| JP | 2001286980 | A | 10/2001 |
| JP | 2001516834 | A | 10/2001 |
| JP | 2001316185 | A | 11/2001 |
| JP | 2002127261 | A | 5/2002 |
| JP | 2002514996 | A | 5/2002 |
| JP | 2003053480 | A | 2/2003 |
| JP | 2004508201 | A | 3/2004 |
| JP | 2005028455 | A | 2/2005 |
| JP | 2006029329 | A | 2/2006 |
| JP | 2006051542 | A | 2/2006 |
| JP | 2006504530 | A | 2/2006 |
| JP | 2006169411 | A | 6/2006 |
| JP | 2006257323 | A | 9/2006 |
| JP | 2008155a4 | A | 7/2008 |
| JP | 2008183566 | | 8/2008 |
| WO | 9817418 | A1 | 4/1998 |
| WO | 9837310 | A1 | 8/1998 |

OTHER PUBLICATIONS

International Search Report and Written Opinion dated Jul. 30, 2013 which was issued in connection with PCT Patent Application No. PCT/US13/37753 which was filed on Apr. 23, 2013.

Unofficial English Translation of Japanese Office Action issued in connection with corresponding JP Application No. 2015507258 dated Nov. 4, 2015.

U.S. Office Action issued in connection with Related U.S. Appl. No. 10/675,374, filed Jan. 20, 2006.

U.S. Office Action issued in connection with Related U.S. Appl. No. 10/675,374, filed Jun. 7, 2006.

U.S. Office Action issued in connection with Related U.S. Appl. No. 10/675,374, filed Nov. 17, 2006.

European Search Report and Opinion issued in connection with related EP Application No. 07101040.9 dated Jul. 26, 2007.

European Search Report and Opinion issued in connection with related EP Application No. 07101040.9 dated May 8, 2007.

U.S. Office Action issued in connection with Related U.S. Appl. No. 11/256,823, filed Jul. 25, 2007.

U.S. Office Action issued in connection with Related U.S. Appl. No. 11/256,823, filed Mar. 8, 2007.

European Search Report and Opinion issued in connection with related EP Application No. 07121580.0 dated May 16, 2008.

European Search Report and Opinion issued in connection with related EP Application No. 07121789.7 dated Apr. 3, 2008.

U.S. Office Action issued in connection with Related U.S. Appl. No. 11/256,823, filed Dec. 10, 2008.

U.S. Office Action issued in connection with Related U.S. Appl. No. 11/256,823, filed Jan. 9, 2008.

U.S. Office Action issued in connection with Related U.S. Appl. No. 11/609,117, filed May 5, 2008.

U.S. Office Action issued in connection with Related U.S. Appl. No. 11/256,823, filed Apr. 15, 2009.

European Office Action issued in connection with related EP Application No. 07121789.7 dated Aug. 26, 2009.

U.S. Office Action issued in connection with Related U.S. Appl. No. 11/567,409, filed Nov. 19, 2009.

U.S. Office Action issued in connection with Related U.S. Appl. No. 11/865,926, filed Jul. 28, 2009.

U.S. Notice of Allowance issued in connection with Related U.S. Appl. No. 11/865,926, filed Feb. 18, 2010.

Bruck S. et al., "RF-Aerogels: A New Binding Material for Foundry Application", Journal of Sol-Gel Science and Technology, 2003.

F. Jorge Lino et al., "Ceramic Components for Foundry Industry," Journal of Materials Processing Technology, vol. 142, pp. 628-633, 2003.

Harvey et al., "Non-Axisymmetric Turbine End Wall Design: Part 1 Three-Dimensional Linear Design System", ASME Paper 99-GT-337; Presented at the International Gas Turbine & Aeroengine Congress & Exhibition, Indianapolis, Indiana, 8 pages, 1999.

J. C. Ferreira, "Manufacturing Core-Boxes for Foundry with Rapid Tooling Technology," Journal of Materials Processing Technology, vol. 155-156, pp. 1118-1123, 2004.

Krauss et al., "Rheological Properties of Alumina Injection Feedstocks", Materials Research, vol. 8, pp. 187-189, 2005.

Lorenz Ratke et al., "Mechanical Properties of Aerogel Composites for casting Purposes", Journal of Material Science, vol. 41, pp. 1019-1024, 2006.

Mueller B. et al., Laminated Object Manufacturing for Rapid Tooling and Pattermaking in Foundry Industry, vol. 39, pp. 47-53, 1999.

Product Information sheet for Dow Corning SE 1885 Kit.

Shih et al., "Controlling Secondary-Flow Structure by Leading-Edge Airfoil Fillet and Inlet Swirl to Reduce Aerodynamic Loss and Surface Heat Transfer", Transactions of the ASME, vol. 125, pp. 48-56, 2003.

Sieverding; "Secondary Flows in Straight and Annular Turbine Cascades", Thermodynamics and Fluid Mechanics of Turbomachinery, vol. II, Martinus Nijhoff Publishers, pp. 621-664, 1985.

Takeishi et al., "An Experimental Study of the Heat Transfer and Film Cooling on Low Aspect Ratio Turbine Nozzles", The American Society of Mechanical Engineers, Presented at the Gas Turbine and Aeroengine Congress and Exposition, 9 pages, 1989.

Theiler et al., "Deposition of Graded Metal Matrix Composites by Laser Beam Cladding", BIAS Bremen Institute of Applied Beam Technology, Germany, 10 pages, 2005.

Unofficial English Translation of Chinese Office Action issued in connection with Related CN Application No. 200710307197.3 dated Mar. 12, 2012.

Unofficial English Translation of Japanese Office Action issued in connection with Related JP Application No. 2007-016456 dated Oct. 25, 2011.

Unofficial English Translation of Japanese Office Action issued in connection with Related JP Application No. 2007-311888 dated Apr. 28, 2015.

Unofficial English Translation of Japanese Office Action issued in connection with Related JP Application No. 2007-311888 dated Jan. 8, 2014.

Unofficial English Translation of Japanese Office Action issued in connection with Related JP Application No. 2007-311888 dated Sep. 25, 2012.

Unofficial English Translation of Japanese Office Action issued in connection with Related JP Application No. 2007-317839 dated Aug. 14, 2012.

Unofficial English Translation of Japanese Office Action issued in connection with Related JP Application No. 2007-317839 dated Aug. 27, 2013.

Unofficial English Translation of Japanese Office Action issued in connection with Related JP Application No. 2007-317839 dated Jun. 3, 2014.

U.S. Appl. No. 11 /240,837, filed Sep. 30, 2006, "Methods for Making Ceramic Casting Cores and Related Articles and Processes", H.P. Wang et al.

U.S. Appl. No. 11/256,823, filed Oct. 24, 2005, "Ceramic-Based Molds for Industrial Gas Turbine Metal Castings Using Gelcasting", Huang et al.

U.S. Appl. No. 11/540,741, filed Sep. 29, 2006, "Turbine Angel Wing Sealing Using Surface Depression Treatment", Bunker, Ronald Scott.

U.S. Appl. No. 11/567,409, filed Dec. 6, 2006, "Casting Compositions for Manufacturing Metal Castings and Methods of Manufacturing Thereof", Hsin-Pang Wang et al.

U.S. Appl. No. 11/567,443, filed Dec. 6, 2006, "Disposable Insert, and Use Thereof in a Method for Manufacturing an Airfoil", Ching-Pang Lee, et al.

(56) References Cited

OTHER PUBLICATIONS

U.S. Appl. No. 11/567,477, filed Dec. 6, 2006, "Composite Core Die, Methods of Manufacture Thereof and Articles Manufactured Therefrom", Ching-Pang Lee et al.
U.S. Appl. No. 11/567,521, filed Dec. 6, 2006, "Ceramic Cores, Methods of Manufacture Thereof and Articles Manufactured From the Same", Ching-Pang Lee.
U.S. Appl. No. 11/609,150, filed Dec. 11, 2006, "Method of Modifying the End Wall Contour in a Turbine Using Laser Consolidation and the Turbines Derived Therefrom", Ching-Pang Lee et al.
U.S. Appl. No. 11/635,749, filed Dec. 7, 2006, "Processes for the Formation of Positive Features on Shroud Components, and Related Articles", Ching-Pang Lee.
Japanese Search Report issued in connection with related JP Application No. 2007-016456 dated Oct. 20, 2011.
Japanese Search Report issued in connection with related JP Application No. 2007-311888 dated Aug. 15, 2012.

* cited by examiner

TURBINE AIRFOIL WITH LOCAL WALL THICKNESS CONTROL

BACKGROUND OF THE INVENTION

This invention relates generally to gas turbine engine airfoils, and more particularly to apparatus and methods for cooling hollow turbine airfoils.

A typical gas turbine engine includes a turbomachinery core having a high pressure compressor, a combustor, and a high pressure turbine in serial flow relationship. The core is operable in a known manner to generate a primary gas flow. The high pressure turbine (or "HPT") includes one or more stages which extract energy from the primary gas flow. Each stage comprises row of stationary vanes or nozzles that direct gas flow into a downstream row of blades or buckets carried by a rotating disk. These components operate in an extremely high temperature environment. To ensure adequate service life, the vanes and blades are hollow and are provided with a flow of coolant, such as air extracted (bled) from the compressor. This coolant flow is circulated through the hollow airfoil's internal coolant path and is then exhausted through a plurality of cooling holes.

One type of cooling hole that has been found effective is a shaped or diffuser hole that includes a circular metering portion and a flared portion that acts as a diffuser. The shaped diffuser holes can be oriented axially or parallel to the gas stream (indicated by the arrow "G" in FIG. 1), or they can be oriented vertically at various angles relative to a radial line drawn to engine centerline. Recent experience with HPT airfoils has shown that reduced airfoil casting wall thickness because of manufacturing process variation can reduce diffuser hole effectiveness. This can be countered by increasing wall thickness for the entire airfoil, but this results in undesirable weight increase.

Accordingly, there is a need for a turbine airfoil with diffuser holes that perform effectively without excessive weight increase.

BRIEF DESCRIPTION OF THE INVENTION

This need is addressed by the present invention, which provides a turbine airfoil having diffuser holes. The wall thickness of the airfoil is locally increased at the location of the diffuser holes.

According to one aspect of the invention, a turbine airfoil for a gas turbine engine includes: an outer peripheral wall having an external surface, the outer peripheral wall enclosing an interior space and including a concave pressure sidewall and a convex suction sidewall joined together at a leading edge and at a trailing edge; wherein the outer peripheral wall has a varying wall thickness which incorporates a locally-thickened wall portion; and a film cooling hole having a shaped diffuser exit passing through the outer peripheral wall within the locally-thickened wall portion.

According to another aspect of the invention, a turbine blade for a gas turbine engine includes: an airfoil having a root and a tip, the airfoil defined by an outer peripheral wall having an external surface, the outer peripheral wall enclosing an interior space and including a concave pressure sidewall and a convex suction sidewall joined together at a leading edge and at a trailing edge; wherein the outer peripheral wall tapers in thickness from a maximum value at the root to a minimum value at the tip; wherein the outer peripheral wall includes a first locally-thickened portion at the root and a second locally-thickened portion at the tip, the first and second locally-thickened portions having equal thickness; and first and second film cooling holes each having a shaped diffuser exit, the first film cooling hole passing through the outer peripheral wall within the first locally-thickened portion and the second film cooling hole passing through the outer peripheral wall within the second locally-thickened portion.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
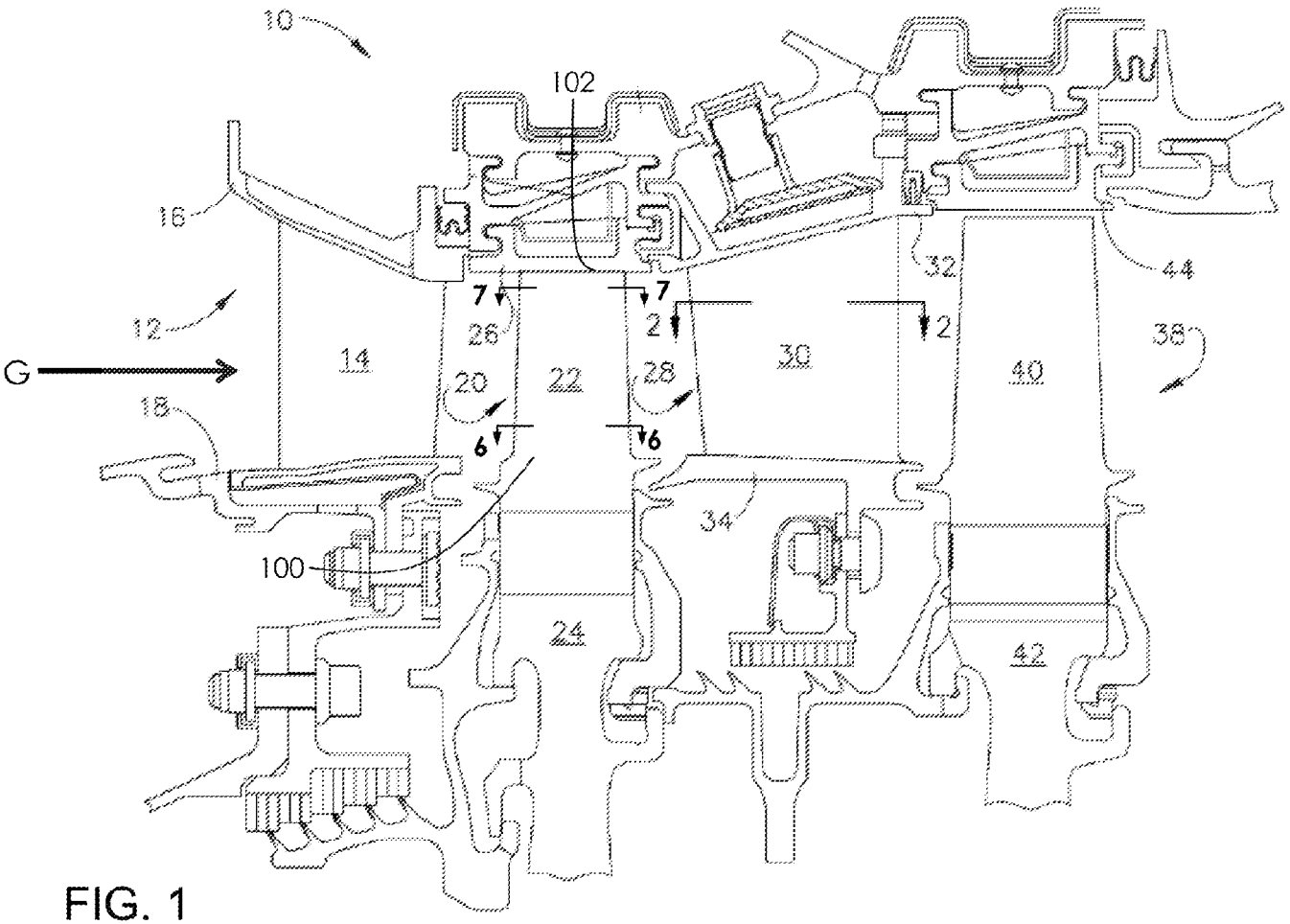
FIG. 1 is a schematic cross-sectional view of a portion of a turbine section of a gas turbine engine, incorporating airfoils constructed in accordance with an aspect of the present invention.

Referring to the drawings wherein identical reference numerals denote the same elements throughout the various views, FIG. 1 depicts a portion of a high pressure turbine 10, which is part of a gas turbine engine of a known type. The turbine shown is a two stage configuration, however high pressure turbines may be a single or multiple stages, each comprising of a nozzle and blade row. The function of the high pressure turbine 10 is to extract energy from high-temperature, pressurized combustion gases from an upstream combustor (not shown) and to convert the energy to mechanical work, in a known manner. The high pressure turbine 10 drives an upstream compressor (not shown) through a shaft so as to supply pressurized air to the combustor.

In the illustrated example, the engine is a turbofan engine and a low pressure turbine would be located downstream of the high pressure turbine 10 and coupled to a fan. However, the principles described herein are equally applicable to turboprop, turbojet, and turboshaft engines, as well as turbine engines used for other vehicles or in stationary applications.

The high pressure turbine 10 includes a first stage nozzle 12 which comprises a plurality of circumferentially spaced airfoil-shaped hollow first stage vanes 14 that are supported between an arcuate, segmented first stage outer band 16 and an arcuate, segmented first stage inner band 18. The first stage vanes 14, first stage outer band 16 and first stage inner band 18 are arranged into a plurality of circumferentially adjoining nozzle segments that collectively form a complete 360° assembly. The first stage outer and inner bands 16 and 18 define the outer and inner radial flowpath boundaries, respectively, for the hot gas stream flowing through the first stage nozzle 12. The first stage vanes 14 are configured so as to optimally direct the combustion gases to a first stage rotor 20.

The first stage rotor 20 includes an array of airfoil-shaped first stage turbine blades 22 extending outwardly from a first stage disk 24 that rotates about the centerline axis of the engine. A segmented, arcuate first stage shroud 26 is arranged so as to closely surround the first stage turbine blades 22 and thereby define the outer radial flowpath boundary for the hot gas stream flowing through the first stage rotor 20.

A second stage nozzle 28 is positioned downstream of the first stage rotor 20, and comprises a plurality of circumferentially spaced airfoil-shaped hollow second stage vanes 30 that are supported between an arcuate, segmented second stage outer band 32 and an arcuate, segmented second stage inner band 34. The second stage vanes 30, second stage outer band 32 and second stage inner band 34 are arranged into a plurality of circumferentially adjoining nozzle segments that collectively form a complete 360° assembly. The second stage outer and inner bands 32 and 34 define the outer and inner radial flowpath boundaries, respectively, for the hot gas stream flowing through the second stage turbine nozzle 34. The second stage vanes 30 are configured so as to optimally direct the combustion gases to a second stage rotor 38.

The second stage rotor 38 includes a radial array of airfoil-shaped second stage turbine blades 40 extending radially outwardly from a second stage disk 42 that rotates about the centerline axis of the engine. A segmented arcuate second stage shroud 44 is arranged so as to closely surround the second stage turbine blades 40 and thereby define the outer radial flowpath boundary for the hot gas stream flowing through the second stage rotor 38.

Figure 2:
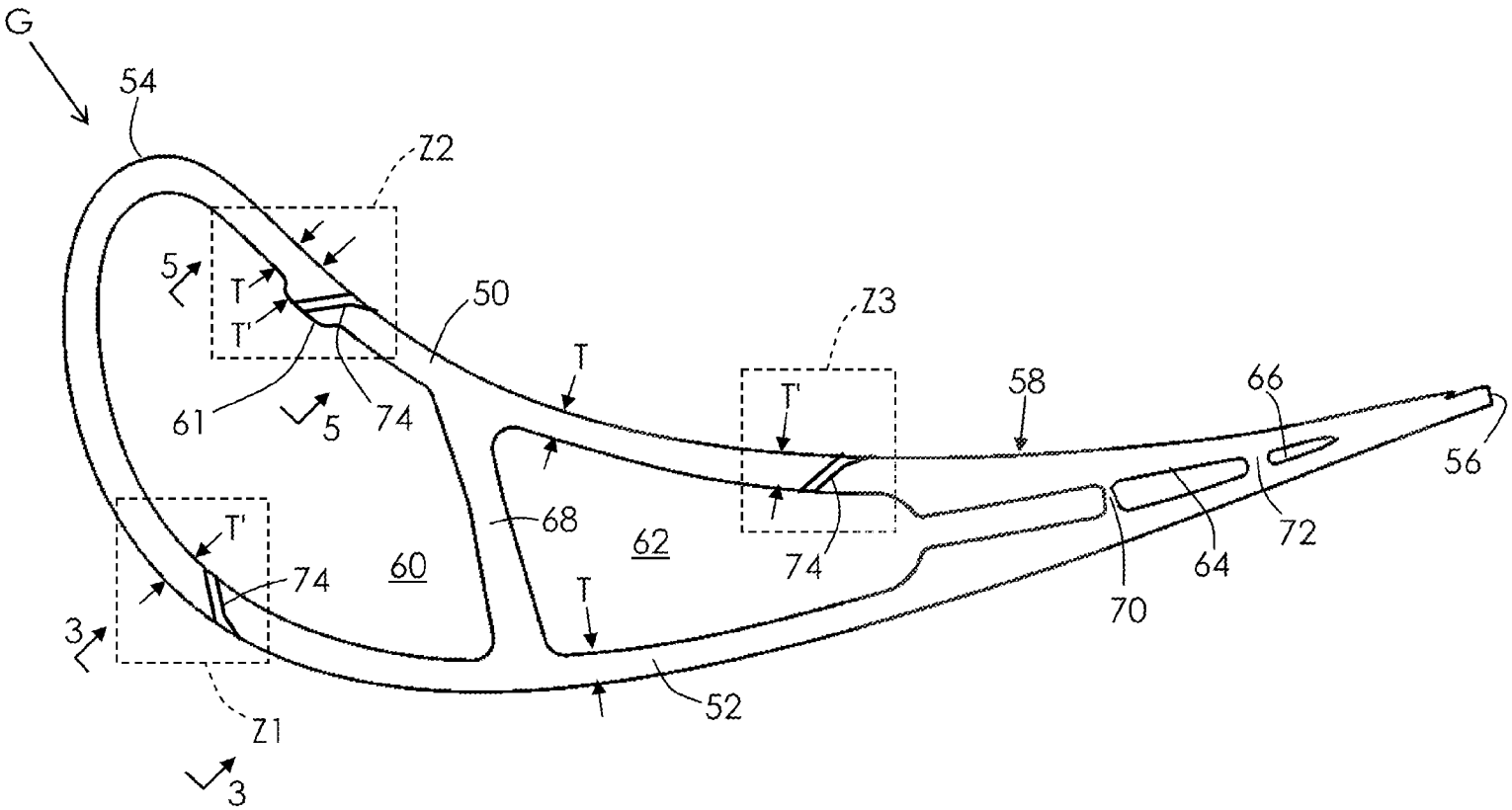
FIG. 2 is a cross-sectional view taken along lines 2-2 in FIG. 1.

A cross-sectional view of one of the second stage vanes 30 is illustrated in FIG. 2. While a stationary airfoil is used to illustrate the invention, the principles of the present invention are applicable to any turbine airfoil having one or more cooling holes formed therein, for example rotating turbine blades. The hollow vane 30 has an outer peripheral wall surrounding an interior space of the vane 30. The outer peripheral wall includes a concave pressure sidewall 50 and a convex suction sidewall 52 joined together at a leading edge 54 and at a trailing edge 56. Collectively the pressure sidewall 50 and the suction sidewall 52 define the exterior surface 58 of the vane 30. The vane 30 may take any configuration suitable for redirecting flow from the first stage turbine blades 22 to the second stage turbine blades 40. The vane 30 may be formed as a one-piece casting of a suitable superalloy, such as a nickel-based superalloy, which has acceptable strength at the elevated temperatures of operation in the gas turbine engine.

Other manufacturing methods are known, such as disposable core die casting and direct metal laser sintering (DMLS) or direct metal laser melting (DMLM), which may be used to create the vane 30. Such methods may permit additional flexibility in creating closer component when implementing the selective thickening, as compared to convention casting. An example of a disposable core die casting process is described in U.S. Pat. No. 7,487,819 to Wang et al., the disclosure of which is incorporated herein by reference. DMLS is a known manufacturing process that fabricates metal components using three-dimensional information, for example a three-dimensional computer model, of the component. The three-dimensional information is converted into a plurality of slices, each slice defining a cross section of the component for a predetermined height of the slice. The component is then "built-up" slice by slice, or layer by layer, until finished. Each layer of the component is formed by fusing a metallic powder using a laser.

The vane 30 has an internal cooling configuration that includes, from the leading edge 54 to the trailing edge 56, first, second, third, and fourth radially extending cavities 60, 62, 64, and 66, respectively. The first and second cavities 60 and 62 are separated by a first rib 68 extending between the pressure an suction sidewalls 50 and 52, the third cavity 64 is separated from the second cavity 62 by a second rib 70 extending between the pressure an suction sidewalls 50 and 52, and the fourth cavity 66 is separated from the third cavity 64 by a third rib 72 extending between the pressure an suction sidewalls 50 and 52. The vane's internal cooling configuration, as described thus far, is used merely as an example. The principles of the present invention are applicable to a wide variety of cooling configurations.

In operation, the cavities 60, 62, 64, and 66 receive a coolant (usually a portion of the relatively cool compressed air bled from the compressor) through an inlet passage (not shown). The coolant may enter each cavity 60, 62, 64, and 66 in series or all of them in parallel. The coolant travels through the cavities 60, 62, 64, and 66 to provide convection and/or impingement cooling of the vane 30. The coolant then exits the vane 30, through one or more film cooling holes 74. As is well known in the art, the film cooling holes 74 may be arranged in various rows or arrays as needed for a particular application. Coolant ejection angle is typically 15 to 35 degrees off the local tangency of the airfoil external surface 58.

Figure 3:
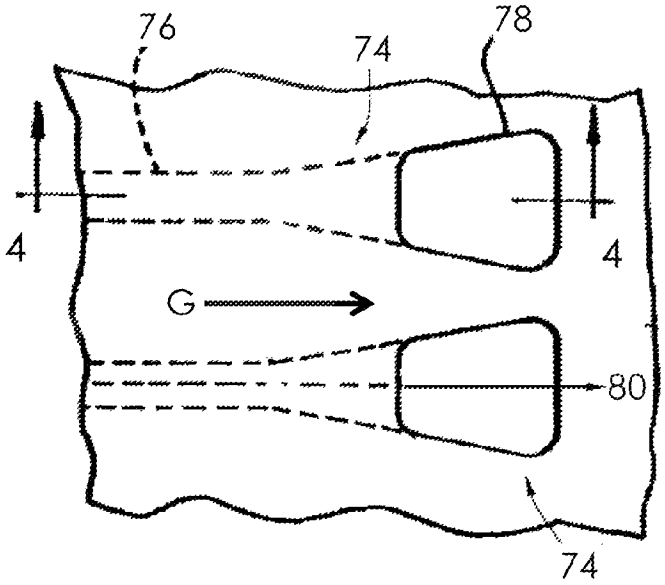
FIG. 3 is a view taken along lines 3-3 of FIG. 2.
Figure 4:
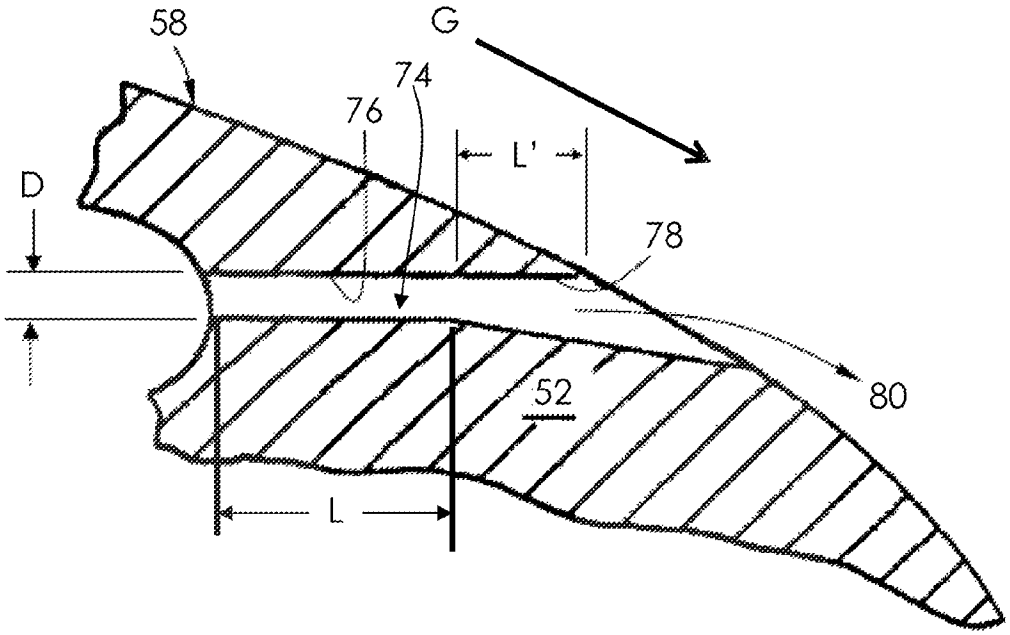
FIG. 4 is a view taken along lines 4-4 of FIG. 3.

In particular, film cooling hole configuration 74 comprises shaped diffuser exits. One of these holes 74 is shown in detail in FIGS. 3 and 4. The cooling hole 74 includes an upstream portion 76 (also referred to as a metering portion) and a downstream portion 78. Referring to FIG. 4, the upstream portion 76 defines a channel which communicates with the hollow interior of the vane 30 and the downstream portion 78 which communicates with the convex exterior surface 58 of the vane 30; thus, referring to FIGS. 3 and 4, cooling air in the airfoil interior is forced, during operation of the gas turbine, through the upstream portion 76 to the downstream portion 78 and out the opening of hole 74 on exterior surface 58 as shown by arrows 80. The upstream portion 76 is substantially cylindrical or circular in cross-section. As illustrated, the downstream portion 78 is substantially trapezoidal in cross-section, but other types of flared diffuser shapes are possible. As shown in FIGS. 3 and 4, the downstream portion 78 flares radially outwardly in the direction of cooling air flow 80 and provides an increasing cross-sectional area as cooling air travels downstream. The increasing cross-sectional area functions as a diffuser which reduces the velocity of cooling airstream 80 and thereby causes airstream 80 to cling to the exterior surface 58 for optimum cooling, rather than to separate from the exterior surface 58.

Several parameters are relevant to the performance of the cooling hole 74. One such parameter is the "blowing ratio", which is a ratio of local flowpath to coolant gas parameters.

Another critical parameter is the ratio L'/D, or the "hooded" diffuser length "L'" divided by the diameter "D" of the circular or metering section of the film hole 76 In addition, proper metering length "L" must be maintained to provide directionality for coolant exiting the film hole. The metering length also serves to assure proper levels of coolant are utilized, thereby sustaining engine performance. For optimum cooling hole effectiveness, it is desirable to tailor the L'/D ratio to the specific conditions of the coolant flow and the free stream flow, which both tend to vary by location on the airfoil. Given a fixed hole diameter D, the only parameter which is variable is the distance L'.

This distance can be affected by changing the wall thickness "T". A locally thicker wall will enable the diffuser portion to be manufactured deeper into the wall from the external gas-side surface. This permits sufficient hooded length without comprising metering length, L. In prior art airfoils, the thickness "T" of the walls (e.g. sidewalls 50 and 52, see FIG. 2) would typically be constant (or intended to be constant) for the entire airfoil in the case of vanes, or typically be constant for very large radial and chordwise (axial) extents on blades. Often, areas of airfoil that contain smaller nominal wall thickness are more susceptible to thickness variations. As a result, there is insufficient wall thickness to attain optimum L'/D ratio or conversely, insufficient metering length, L may exist. The airfoil wall thickness T could be increased uniformly, but this would result in undesired weight increase.

In the present invention, the local wall thickness is selected to be adequate for optimum performance of the cooling hole 74. The thickness is locally and selectively increased as required, resulting in a significantly smaller weight increase. As seen in FIG. 2, the suction sidewall 52 may have a thickness "T'", greater than the nominal wall thickness T, wherein T' is sufficient to result in the desired L'/D ratio. Here the entire convex wall of the first cavity 60 has been thickened while maintaining more typical wall thickness for the concave or pressure side of the airfoil 58.

Smaller regions of the airfoil may incorporate selective thickening. An example of this is seen on the convex or suction side of the airfoil in zone Z1. Here a local wall thickening only on the suction side of the first cavity 60 is implemented. This results in less weight increase over thickening the entire convex or suction side.

Figure 5:
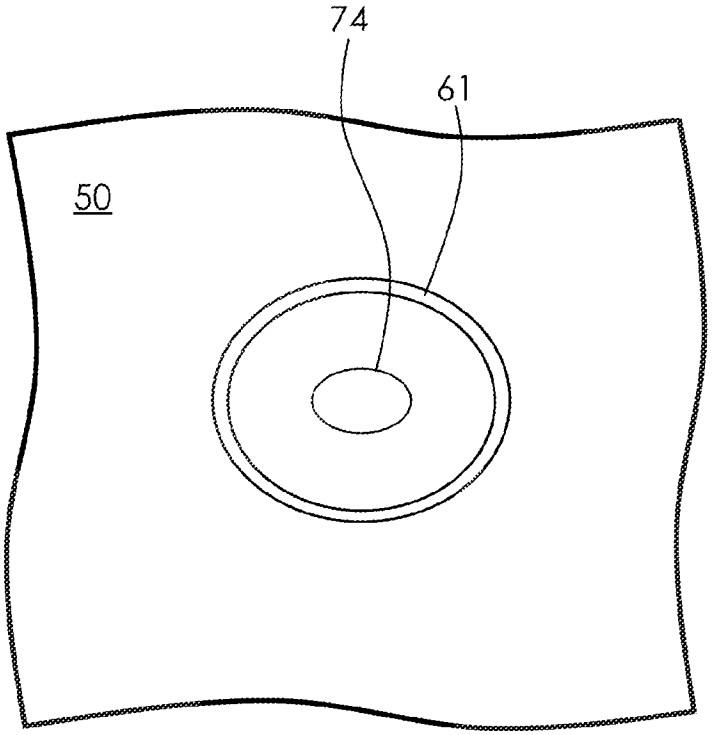
FIG. 5 is a view taken along lines 5-5 of FIG. 2.

Another method of selective thickening includes providing one or more discrete elements protruding from the inner surface of the outer peripheral wall, such as local embossments, bosses, or bumps on the coolant side of the airfoil as seen in zone Z2 (labeled 61 in FIGS. 2 and 5). This permits even less weight increase while maintaining optimum cooling effectiveness. The embossments have the added advantage of enhanced coolant side heat transfer due to enhanced internal convection heat transfer. This helps offset potential increase temperature gradients caused by local increases in thermal mass. Temperature gradients are further reduced because increased film effectiveness can now be attained.

Local chordwise tapering may also be used to smoothly transition the airfoil wall from the increased thickness T' down to the nominal thickness T (seen in FIG. 2) away from the cooling holes 74 as seen in zone Z3. As another alternative, the wall thickness may be of the increased dimension T' for the entire cavity where cooling holes 74 are present, and the nominal thickness T where the cooling holes are absent. To implement this alternative to the illustrated example, the first and second cavities 60 and 62 would have the increased wall thickness T', while the third and fourth cavities 64 and 66 would have the nominal wall thickness T.

Figure 6:
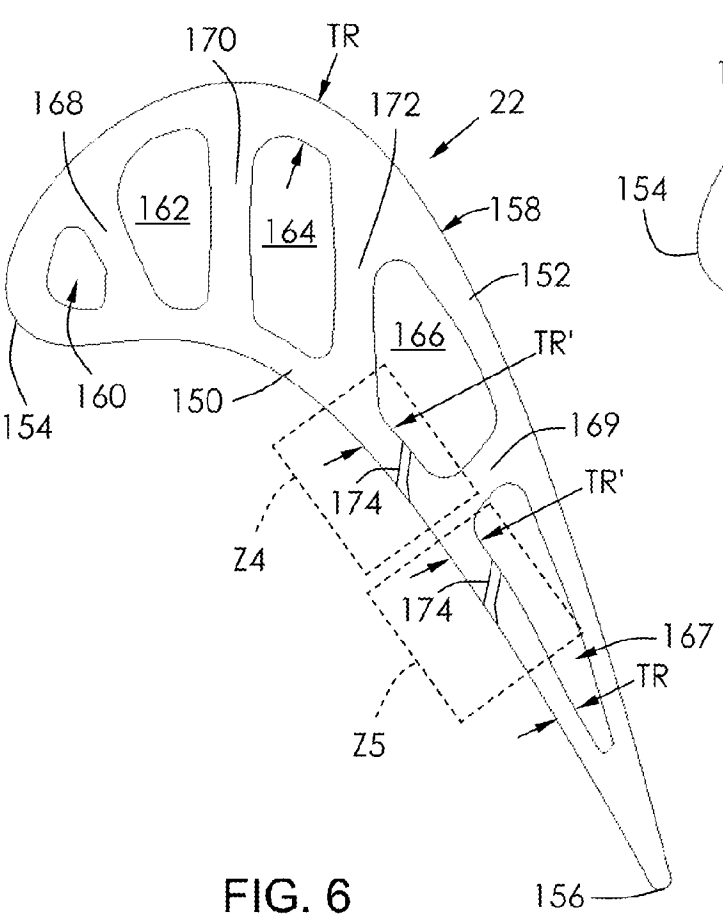
FIG. 6 is a view taken along lines 6-6 of FIG. 1.

As noted above, the principles of the present invention may also be applied to rotating airfoils as well. For example, a cross-sectional view of one of the first stage turbine blades 22 is illustrated in FIG. 6. The hollow blade 22 includes a root 100 and a tip 102 (see FIG. 1). An outer peripheral wall surrounds an interior space of the blade 22. The outer peripheral wall includes a concave pressure sidewall 150 and a convex suction sidewall 152 joined together at a leading edge 154 and at a trailing edge 156. Collectively the pressure sidewall 150 and the suction sidewall 152 define the exterior surface 158 of the blade 22. The blade 22 may take any configuration suitable for extracting energy from the passing combustion gas flow. The blade 22 may be constructed from a suitable alloy in the manner described above.

FIG. 6 shows the turbine blade 22 in cross-section near the root 100. The turbine blade 22 has an internal cooling configuration that includes, from the leading edge 154 to the trailing edge 156, first, second, third, fourth, and fifth radially extending cavities 160, 162, 164, 166, and 167, respectively. The first and second cavities 160 and 162 are separated by a first rib 168 extending between the pressure and suction sidewalls 150 and 152, the third cavity 164 is separated from the second cavity 162 by a second rib 170 extending between the pressure an suction sidewalls 150 and 152, the fourth cavity 166 is separated from the third cavity 164 by a third rib 172 extending between the pressure and suction sidewalls 150 and 152, and the fifth cavity 167 is separated from the fourth cavity 166 by a fourth rib 169 extending between the pressure and suction sidewalls 150 and 152. The blade's internal cooling configuration, as described thus far, is used merely as an example.

The turbine blade 22 includes one or more diffuser-type film cooling holes 174 identical to the cooling holes 74 described above, each including an upstream metering portion and a divergent downstream portion.

The turbine blade 22 rotates in operation and is therefore subject to centrifugal loads as well as aerodynamic and thermal loads. In order to reduce these loads it is known to reduce the mass of the radially outer portion of the blade 22 by tapering the outer peripheral wall from the root 100 to the tip 102. In other words, the nominal wall thickness "TR" near the root 100, seen in FIG. 6, is greater than the nominal wall thickness "TT" near the tip 102, seen in FIG. 7. Generally the nominal wall thickness is maximum at the root 100 and minimum at the tip 102. This optional feature may be referred to herein as "radial tapering" of the wall thickness. The local or selective thickening principles of the present invention described above may be applied to a turbine blade having walls with such radial tapering.

For example, as seen in FIG. 6, exemplary radially-extending rows of cooling holes 174 are located in the fourth and fifth cavities 166 and 167. The local wall thickness of the outer peripheral wall is selected to be adequate for optimum performance of the cooling hole 174. The portion of the pressure sidewall 150 defining the fourth cavity may have a thickness "TR'", equal to or greater than the nominal wall thickness TR, wherein TR' is sufficient to result in the desired L'/D ratio (see zone Z4). In the fifth cavity 167 (see zone Z5), the pressure sidewall 150 is locally chordwise tapered, with an increased thickness TR' at the cooling hole 174 and a smooth transition from the increased thickness TR' down to the nominal thickness TR away from the cooling holes 174. It is noted that, when implementing chordwise tapering, the thickest section of a wall portion may occur anywhere within the length of the wall portion (i.e. nominal thickness at its ends and local thickening in the central portion).

Figure 7:
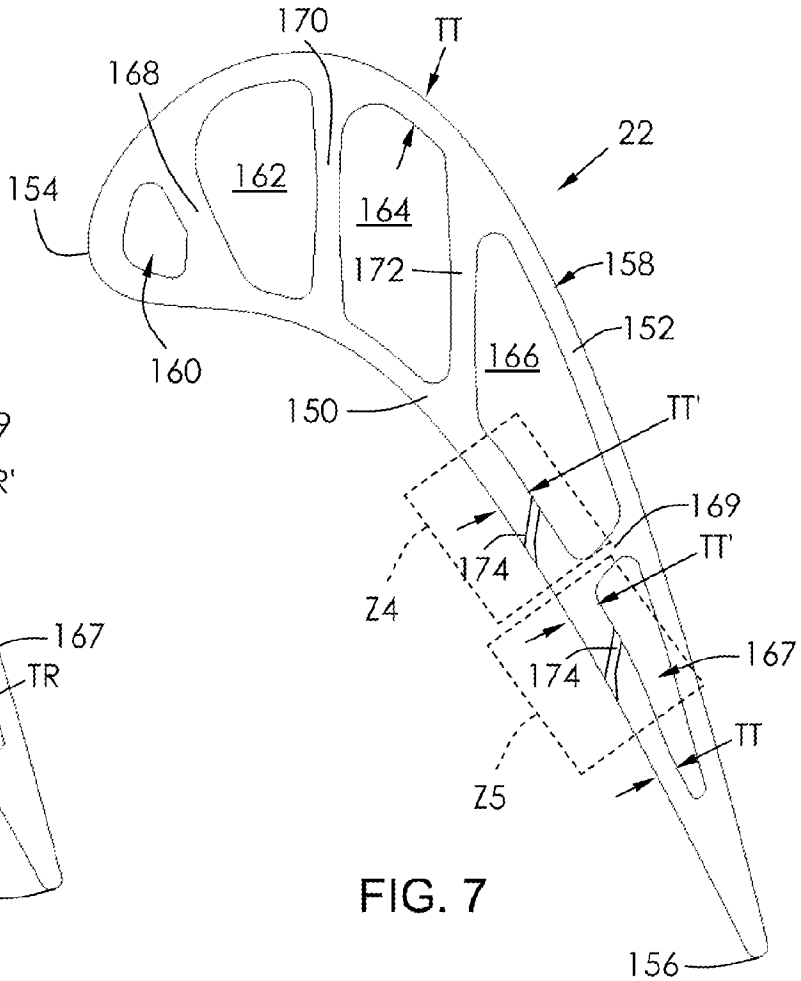
FIG. 7 is a view taken along lines 7-7 of FIG. 1.

The local or selective thickness increase is maintained throughout the radial span of the turbine blade 22, independent of the radial tapering. For example, as shown in FIG. 7, the portion of the suction sidewall 152 defining the fourth cavity 166 may have a thickness "TT'", greater than the nominal wall thickness TT, wherein TT' is sufficient to result in the desired L'/D ratio, and may be equal to TR', even though the nominal wall thickness TT is substantially less than the nominal wall thickness TR. In the fifth cavity 167, the suction sidewall 152 is locally chordwise tapered, with an increased thickness TT' at the cooling hole 174 and a smooth transition from the increased thickness TT' down to the nominal thickness TT away from the cooling holes 174.

In other words, the locally-thickened wall portion surrounding each cooling hole 174 may be much thicker than the nominal thickness at the tip 102, but only slightly thicker than (or possibly equal to) the nominal thickness at the root 100. As with the vane 30, the locally-increased wall thickness may be provided through a combination of discrete protruding elements, chordwise-tapered walls, and/or thickening of specific wall portions.

The present invention locally increases airfoil wall thickness such that a minimum wall condition under expected casting variation will still allow for proper diffuser hole geometry L' while maintaining metering length. A wall thickness properly sized to optimize the L'/D criteria while maintaining proper metering length results in a cooling hole with a maximum cooling effectiveness. This concept provides for required thickness while minimizing weight increase for the entire airfoil.

The foregoing has described a turbine airfoil for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A turbine airfoil for a gas turbine engine, the turbine airfoil comprising:

a root;

a tip;

an outer peripheral wall comprising:

an external surface, the outer peripheral wall enclosing an interior space; and a concave pressure sidewall and a convex suction sidewall joined together at a leading edge and at a trailing edge, wherein the outer peripheral wall has a varying wall thickness which incorporates a locally-thickened wall portion and the outer peripheral wall tapers in thickness from a maximum value at the root to a minimum value at the tip; and a film cooling hole comprising a shaped diffuser exit passing through the outer peripheral wall within the locally-thickened wall portion.

2. The turbine airfoil of claim 1, wherein the film cooling hole further comprises an upstream metering portion which communicates with the interior space of the airfoil and a divergent downstream portion which communicates with the external surface of the turbine airfoil.

3. The turbine airfoil of claim 1, wherein the locally-thickened wall portion is defined by a discrete element protruding from an inner surface of the outer peripheral wall.

4. The turbine airfoil of claim 1, wherein the outer peripheral wall comprises a tapered portion incorporating both a relatively smaller thickness and a relatively larger thickness, and the locally-thickened wall portion is defined by the relatively larger thickness.

5. The turbine airfoil of claim 1, wherein the locally-thickened wall portion is defined by one of the sidewalls which is thicker than the other of the sidewalls.

6. The turbine airfoil of claim 1, further comprising a rib extending between the pressure sidewall and the suction sidewall, wherein the rib and portions of the sidewalls adjacent to the rib cooperate to define two or more cavities within the interior space, and wherein one of the portions of the sidewalls defines the locally-thickened wall portion.

7. The turbine airfoil of claim 1, wherein the airfoil is part of a turbine vane and extends between an arcuate outer band and an arcuate inner band.

8. The turbine airfoil of claim 1, wherein the airfoil is part of a turbine blade.

9. The turbine airfoil of claim 8, wherein the outer peripheral wall comprises a first locally-thickened portion at the root and a second locally-thickened portion at the tip, wherein the first and second locally-thickened portions have equal thickness.

10. A turbine blade for a gas turbine engine, the turbine blade comprising:

an airfoil comprising a root and a tip, the airfoil defined by an outer peripheral wall comprising:

an external surface, the outer peripheral wall enclosing an interior space; and a concave pressure sidewall and a convex suction sidewall joined together at a leading edge and at a trailing edge, wherein the outer peripheral wall tapers in thickness from a maximum value at the root to a minimum value at the tip, wherein the outer peripheral wall further comprises a first locally-thickened portion at the root and a second locally-thickened portion at the tip, the first and second locally-thickened portions having equal thickness; and first and second film cooling holes each comprising a shaped diffuser exit, the first film cooling hole passing through the outer peripheral wall within the first locally-thickened portion and the second film cooling hole passing through the outer peripheral wall within the second locally-thickened portion.

11. The turbine blade of claim 10, wherein one of the first film cooling hole and the second film cooling hole comprises an upstream metering portion which communicates with the interior space of the turbine blade and a divergent downstream portion which communicates with the external surface of the turbine blade.

12. The turbine blade of claim 10, wherein the outer peripheral wall further comprises a tapered portion incorporating both a relatively smaller thickness and a relatively larger thickness, and the locally-thickened wall portion is defined by the relatively larger thickness.

13. The turbine blade of claim 10, wherein the locally-thickened wall portion is defined by one of the sidewalls which is thicker than the other of the sidewalls.

14. The turbine blade of claim 10, further comprising a rib extending between the concave pressure sidewall and the convex suction sidewall, wherein the rib and portions of the sidewalls adjacent to the rib cooperate to define two or more cavities within the interior space, and wherein one of the portions of the sidewalls defines the locally-thickened wall portion.

* * * * *